US010055960B2

(12) United States Patent
Follett

(10) Patent No.: US 10,055,960 B2
(45) Date of Patent: Aug. 21, 2018

(54) ULTRAVIOLET EMITTER FOR USE IN A FLAME DETECTOR AND A METHOD OF MAKING THE SAME

(71) Applicant: Carrier Corporation, Jupiter, FL (US)

(72) Inventor: Gary J. Follett, Saint Paul, MN (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/542,059

(22) PCT Filed: Dec. 29, 2015

(86) PCT No.: PCT/US2015/067871

§ 371 (c)(1),
(2) Date: Jul. 6, 2017

(87) PCT Pub. No.: WO2016/111886

PCT Pub. Date: Jul. 14, 2016

(65) Prior Publication Data

US 2017/0372596 A1 Dec. 28, 2017

Related U.S. Application Data

(60) Provisional application No. 62/100,354, filed on Jan. 6, 2015.

(51) Int. Cl.
*G08B 17/00* (2006.01)
*G08B 17/12* (2006.01)
(Continued)

(52) U.S. Cl.
CPC ..... *G08B 17/12* (2013.01); *F23N 5/082* (2013.01); *G08B 17/00* (2013.01); *G08B 29/145* (2013.01)

(58) Field of Classification Search
CPC .... F23N 5/08; F23N 3029/00; F23N 3029/02; F23N 3029/08; F23N 3029/082;
(Continued)

(56) References Cited

U.S. PATENT DOCUMENTS 2,647,217 A 7/1953 Foulke
3,142,758 A * 7/1964 Dietz ..... G01T 7/125 250/372
(Continued)

FOREIGN PATENT DOCUMENTS

CN 2932336 Y 8/2007
CN 203733251 U 7/2014
(Continued)

OTHER PUBLICATIONS

European Patent Office, International Search Report, dated May 9, 2016.
(Continued)

*Primary Examiner* — Van Trieu
(74) *Attorney, Agent, or Firm* — Cantor Colburn LLP

(57) ABSTRACT

A flame detector including an ultraviolet emitter configured to emit ultraviolet light at a strike voltage less than or equal to approximately 230 volts. A method of manufacturing an ultraviolet emitter for use in a flame detector, the ultraviolet emitter including a hermetically sealed, alkali rich, ultraviolet transmissive glass envelope, the method including: (a) wrapping an envelope exterior surface with a conductive material; (b) performing a first injection of at least one non-radioactive gas into the glass envelope at a first pressure; (c) applying a voltage bias to the glass envelope; (d) baking the hermetically sealed, alkali rich, ultraviolet transmissive glass envelope at a baking temperature for a baking duration of time; (e) cooling the hermetically sealed, alkali rich, ultraviolet transmissive glass envelope to a desired
(Continued)

temperature; and (f) performing a second injection of at least one non-radioactive gas into the glass envelope at a second pressure.

18 Claims, 5 Drawing Sheets

(51) Int. Cl.
*G08B 29/14* (2006.01)
*F23N 5/08* (2006.01)

(58) Field of Classification Search
CPC ..... F23N 3029/085; F23N 3029/10; F23N 3029/14; F23N 3029/16; F23N 5/082; G08B 17/00; G08B 17/10; G08B 29/14; G08B 29/145; G08B 17/12
See application file for complete search history.

(56) References Cited

U.S. PATENT DOCUMENTS

| | | | | |
|---|---|---|---|---|
| 3,237,041 | A | 2/1966 | Barnes | |
| 3,286,761 | A | 11/1966 | Engh | |
| 3,755,799 | A * | 8/1973 | Riccardi | F23N 5/082 250/372 |
| 3,767,955 | A | 10/1973 | Johnson | |
| 4,622,485 | A | 11/1986 | Miyashita et al. | |
| 5,256,057 | A * | 10/1993 | Grow | F23N 5/082 431/25 |
| 5,257,013 | A | 10/1993 | Lewkowicz | |
| 5,339,070 | A | 8/1994 | Yalowitz et al. | |
| 5,599,753 | A | 2/1997 | Watzke et al. | |
| 5,748,090 | A | 5/1998 | Borg et al. | |
| 5,854,535 | A | 12/1998 | Hohlfeld et al. | |
| 6,046,452 | A | 4/2000 | Castleman et al. | |
| 6,518,574 | B1 | 2/2003 | Castleman | |
| 7,244,946 | B2 | 7/2007 | Burnette et al. | |
| 2005/0174244 | A1* | 8/2005 | Grow | F23N 5/082 340/577 |
| 2009/0015162 | A1 | 1/2009 | Bernard et al. | |
| 2009/0256460 | A1 | 10/2009 | Allen et al. | |

FOREIGN PATENT DOCUMENTS

| | | | |
|---|---|---|---|
| WO | 8912774 | A1 | 12/1989 |
| WO | 0077825 | A1 | 12/2000 |
| WO | 2009138682 | A2 | 11/2009 |

OTHER PUBLICATIONS

European Patent Office, Written Opinion of the International Searching Authority, dated May 9, 2016.
Net Safety Monitoring Inc., Ultraviolet/Infrared Flame Detector, User Manual for Model UV/IRS-A-X or AR-X, Nov. 23, 2012.

* cited by examiner

ULTRAVIOLET EMITTER FOR USE IN A FLAME DETECTOR AND A METHOD OF MAKING THE SAME

CROSS REFERENCE TO RELATED APPLICATION

The present application is a U.S. national stage of, and claims the priority benefit of, International Patent Application Serial No. PCT/US2015/067871, filed Dec. 29, 2015 and also claims the priority benefit of U.S. Application Ser. No. 62/100,354 filed Jan. 6, 2015, the text and drawings of which are hereby incorporated by reference in their entireties.

TECHNICAL FIELD OF THE DISCLOSED EMBODIMENTS

The presently disclosed embodiments generally relate to fire safety systems, and more particularly, to an ultraviolet emitter for use in a flame detector and a method of making the same.

BACKGROUND OF THE DISCLOSED EMBODIMENTS

Fire detection is an important concern for a variety of different commercial and industrial areas. Fire detection systems are available to sense various attributes of a fire and to warn when a fire is detected. For example, smoke detectors include sensors adapted to sense smoke associated with a fire and to trigger an alarm when a selected level of smoke is detected. Other detectors sense other attributes associated with a fire.

Ultraviolet (UV) light emitted from flames of a particular fire is detected by a flame detector system's UV sensor. When a selected amount of UV light is detected, the flame detector system triggers an alarm.

To ensure their reliable performance and functionality, UV flame detectors are tested periodically. One method of testing involves using a test lamp that emits a broad spectrum of UV light at wavelengths of about 180 nanometers ("nm") to 350 nm. The light is directed towards the UV sensor of the flame detector. If the UV sensor does not detect the light from the tests lamp within an expected range, the detector goes into fault. The UV emitters are often encased within the detectors for simplicity, and convenience.

An example of a type of UV emitter used for optical integrity testing is a Neon glow lamp. This Neon glow lamp is a small device made from glass that is transparent and configured to emit UV light at wavelengths in the range of approximately 200 nm to 350 nm. This Neon glow lamp encases a rarified atmosphere of Neon, Hydrogen, and Argo, as further described in detail in the description of the drawings.

When positioned inside the casing of the detectors, the UV emitters are subject to a phenomenon commonly known as "dark effect." In particular, when Neon Glow UV emitters are stored in the dark for extended periods of time, and without operation, the Neon Glow UV emitters require a higher strike voltage of approximately 240 to approximately 1000 volts, in order to spark or light up and operate again. Additionally, the Neon Glow UV emitters require longer strike duration (i.e. the time it takes for the Neon Glow UV emitter to light up and operate). Typically, strike durations can exceed approximately 10 milliseconds for any subsequent operation after long periods of storage in the dark.

This dark effect results in delayed starting and erratic operation of the Neon Glow UV emitter.

The most commonly employed method of overcoming the dark effect in Neon Glow UV emitters is the addition of radioactive Krypton 85 gas (Kr85) within the emitter at very small amounts. The use of Kr85 to neutralize the dark effect may substantially increase the material costs and/or manufacturing costs. Additionally, the use of Kr85 imposes severe regulatory hurdles. Changes in international regulations surrounding the use and shipment of radioactive materials, such as Kr85, have made it difficult to ship flame detectors with Neon Glow UV emitters containing radioactive materials. Additionally, the effectiveness of the use of Kr85 decreases during the life of the Neon Glow UV emitter, thereby rendering the operation of the flame detector erratic and terminating its useful life.

An effective and reliable Neon Glow UV emitter that operates without a need for radioactive materials would dramatically improve the cost, simplicity, and ease of use of flame detectors. Accordingly, there exists a need for a flame detector using a Neon Glow UV emitter that does not contain radioactive materials.

SUMMARY OF THE DISCLOSED EMBODIMENTS

In one aspect, a flame detector is provided. The flame detector includes an ultraviolet emitter composed of non-radioactive materials, wherein the ultraviolet emitter is configured to emit ultraviolet light at a strike voltage of less than or equal to approximately 230 volts. In one embodiment, the flame detector further includes a sensor, and a microcontroller operably coupled to a power supply and communicatively coupled to the sensor.

In one embodiment, the ultraviolet emitter includes a hermetically sealed, alkali rich, ultraviolet transmissive glass envelope including an envelope proximal end and an envelope distal end. The ultraviolet emitter further includes at least one electrode extending through the envelope proximal end into the hermetically sealed, alkali rich, ultraviolet transmissive glass envelope. In one embodiment, the at least one electrode includes an anode and a cathode. The ultraviolet emitter further includes at least one non-radioactive gas disposed within the hermetically sealed, alkali rich, ultraviolet transmissive glass envelope. In one embodiment, the at least one non-radioactive gas is selected from the group consisting of hydrogen, helium, neon, argon, and xenon.

A method of manufacturing an ultraviolet emitter is provided. The method includes the step of wrapping an exterior surface of the hermetically sealed, alkali rich, ultraviolet transmissive glass envelope with a conductive material having a conductive material length. In one embodiment, the conductive material length is less than a length extending from the envelope distal end to the envelope proximal end.

The method further includes step of performing a first injection of at least one non-radioactive gas into the hermetically sealed, alkali rich, ultraviolet transmissive glass envelope at a first pressure. In one embodiment, the at least one non-radioactive gas is selected from the group consisting of hydrogen, helium, neon, argon, and xenon. In one embodiment, the first pressure is greater than or equal to approximately 17 Torr.

The method further includes the step of applying a voltage bias to the glass envelope. In one embodiment, applying a voltage bias includes connecting a power source to the conductive material and the at least one electrode. In one embodiment, the voltage bias is greater than or equal to approximately 1,900 volts.

The method further includes the step of baking the hermetically sealed, alkali rich, ultraviolet transmissive glass envelope at a baking temperature for a baking duration of time. In one embodiment, the baking temperature is greater than or equal to approximately 260 degrees Celsius (approximately 500 degrees Fahrenheit). In one embodiment, the baking duration of time is less than or equal to approximately 3.5 hours.

The method further includes the step of cooling the hermetically sealed, alkali rich, ultraviolet transmissive glass envelope until the glass envelope reaches a desired temperature. In one embodiment, the desired temperature is approximately room temperature. The method further includes the steps of removing the power source from the hermetically sealed, alkali rich, ultraviolet transmissive glass envelope and removing the conductive material from the exterior surface of the hermetically sealed, alkali rich, ultraviolet transmissive glass envelope.

The method further includes the step of performing a second injection of the at least one non-radioactive gas into the hermetically sealed, alkali rich, ultraviolet transmissive glass envelope at a second pressure. In one embodiment, the at least one non-radioactive gas is selected from the group consisting of hydrogen, helium, neon, argon, and xenon. In one embodiment, the second pressure is greater than or equal to approximately 35 Torr.

DETAILED DESCRIPTION OF THE DISCLOSED EMBODIMENTS

Figure 1:
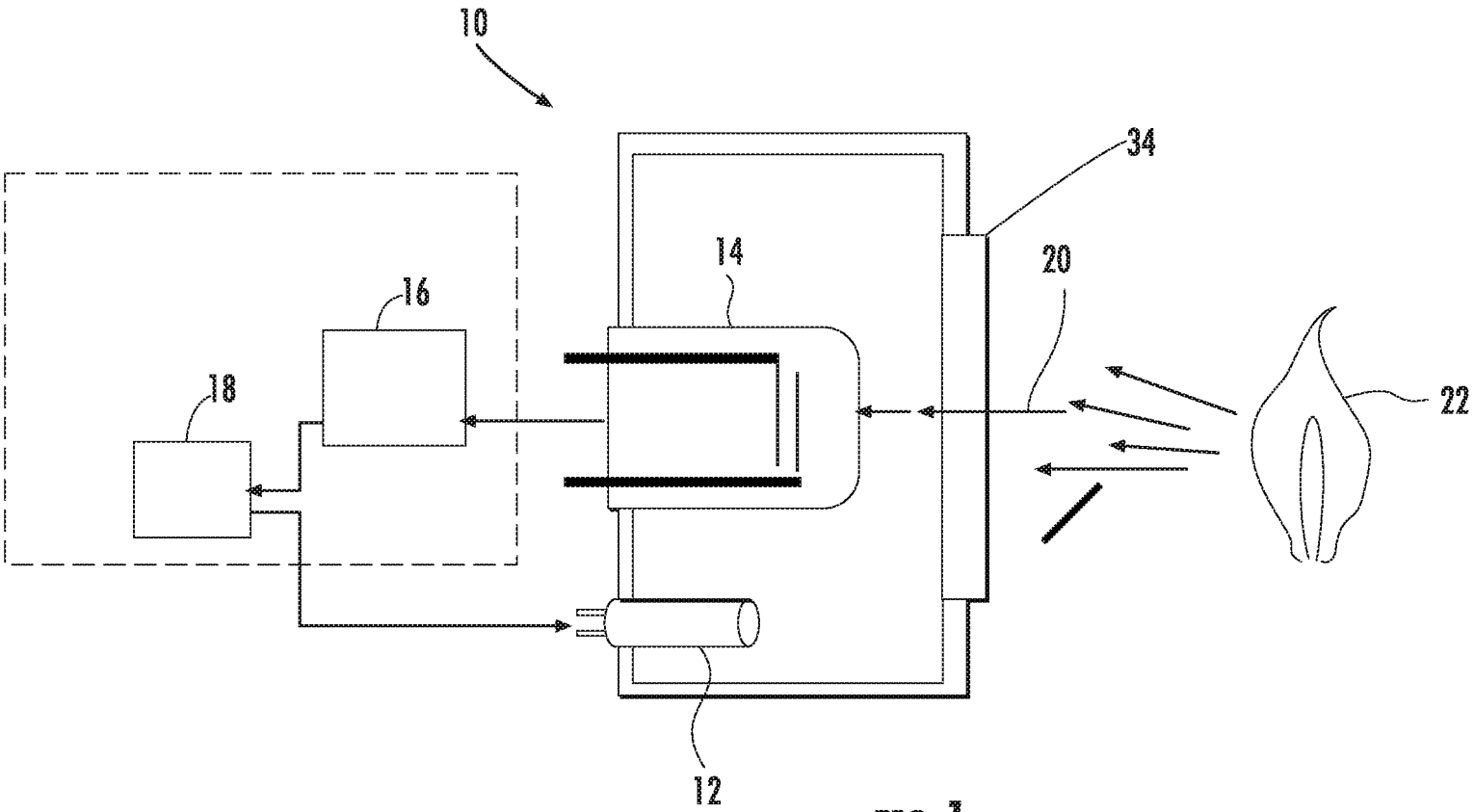
FIG. 1 illustrates a schematic diagram of a flame detector according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a flame detector, generally indicated at 10. The flame detector 10 includes an ultraviolet emitter 12 composed of non-radioactive materials, wherein the ultraviolet emitter 12 is configured to emit ultraviolet light at a strike voltage of less than or equal to approximately 230 volts. It will be appreciated that the strike voltage is the minimum voltage required in order to produce a glow within and ultraviolet light from the ultraviolet emitter 12.

In one embodiment, the flame detector 10 further includes a sensor 14 configured to detect ultraviolet light. It will be appreciated that sensor 14 may include ultraviolet sensors, infrared sensors, or a combination thereof. It will also be appreciated that sensor 14 includes one or more types of photodiodes, for example, silicon carbide (SiC), or gallium phosphide (GaP), to name a few non-limiting examples. It will also be appreciated that sensor 14 is configured to detect UV light including wavelengths of approximately 190 nm to approximately 280 nm within the ultraviolet C range. In one non-limiting example, the electromagnetic spectrum of ultraviolet light is defined most broadly as between approximately 10 nm and approximately 400 nm.

In one embodiment, the flame detector 10 further includes a microcontroller 16 operably coupled to a power supply 18, and communicatively coupled to the sensor 14. The microcontroller 16 is configured to process output from the sensor 14 to identify ultraviolet light 20 emanating from a flame 22. For example, the operation of the flame detector 10 serves to detect the ultraviolet light 20 emanating from the flame 22. The sensor 14, upon the detection of the ultraviolet light 20, transmits a signal to the microcontroller 16. Further, the microcontroller 16 receives the signal and processes the signal to determine if a flame 22 has been detected. If the microcontroller 16 affirms the detection of a flame, the microcontroller 16 initiates a signal to an alarm (not shown), or any other signaling method appreciated in the arts, to alert the user to the detection of a fire. It will be appreciated that the microcontroller 16 may be configured to process signals to and from any other aspect of the flame detector 10. It will be appreciated that the microcontroller 16 includes one or more types of a programmable logic device or similar component that is appreciated in the arts.

Figure 2:
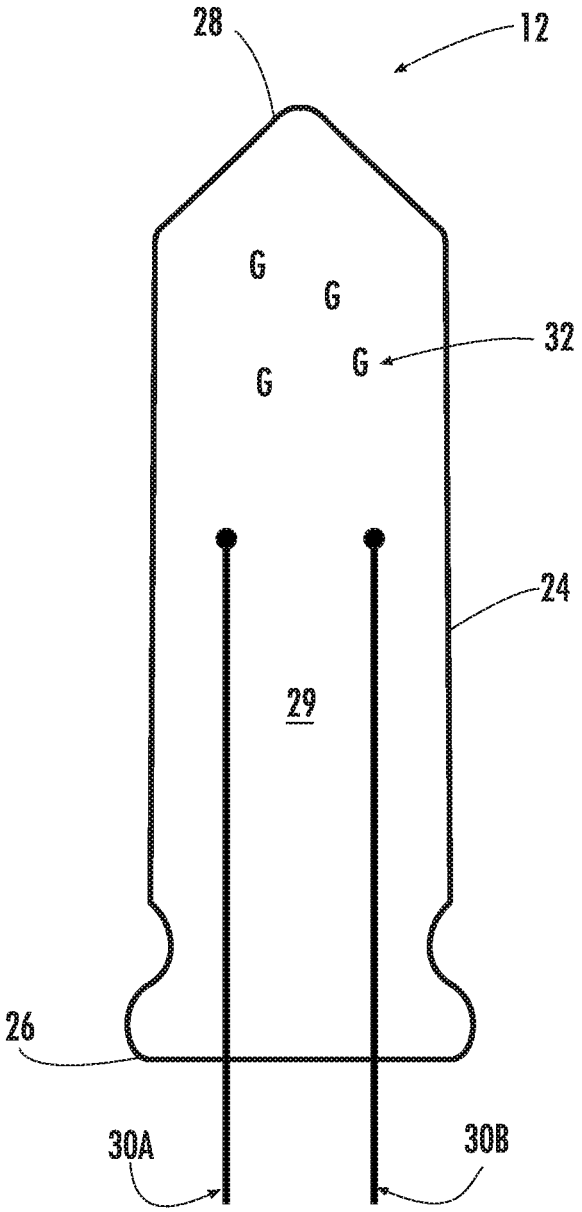
FIG. 2 illustrates a schematic diagram of a flame detector according to at least one embodiment of the present disclosure.

In one embodiment, as shown in FIG. 2 the ultraviolet emitter 12 includes a hermetically sealed, alkali rich, ultraviolet transmissive glass envelope 24 including an envelope proximal end 26, an envelope distal end 28, and a cavity 29 disposed therein. For example, the hermetically sealed, alkali rich, ultraviolet transmissive glass envelope 24 may contain sodium to name one non-limiting example. It will be appreciated that the glass envelope 24 may include other alkali metals such as, potassium, lithium, or boron, to name a few non-limiting examples. The ultraviolet emitter 12 further includes at least one electrode 30 extending through the envelope proximal end 26 into the cavity 29 of the hermetically sealed, alkali rich, ultraviolet transmissive glass envelope 24. In one embodiment, the at least one electrode includes an anode 30A and a cathode 30B. It will be appreciated that the at least one electrode 30 may be composed of one or more conductive materials well known in the arts, such as, nickel-iron alloy, or copper to name a few non-limiting examples.

The ultraviolet emitter 12 further includes at least one non-radioactive gas 32 disposed within the hermetically sealed, alkali rich, ultraviolet transmissive glass envelope 24. In one embodiment, the at least one non-radioactive gas 32 is selected from the group consisting of hydrogen, helium, neon, argon, and xenon, to name just a few non-limiting examples. For example, the non-radioactive gas 32 may include a mixture of approximately 85% neon, approximately 15% hydrogen, and trace amounts of argon.

Figure 3:
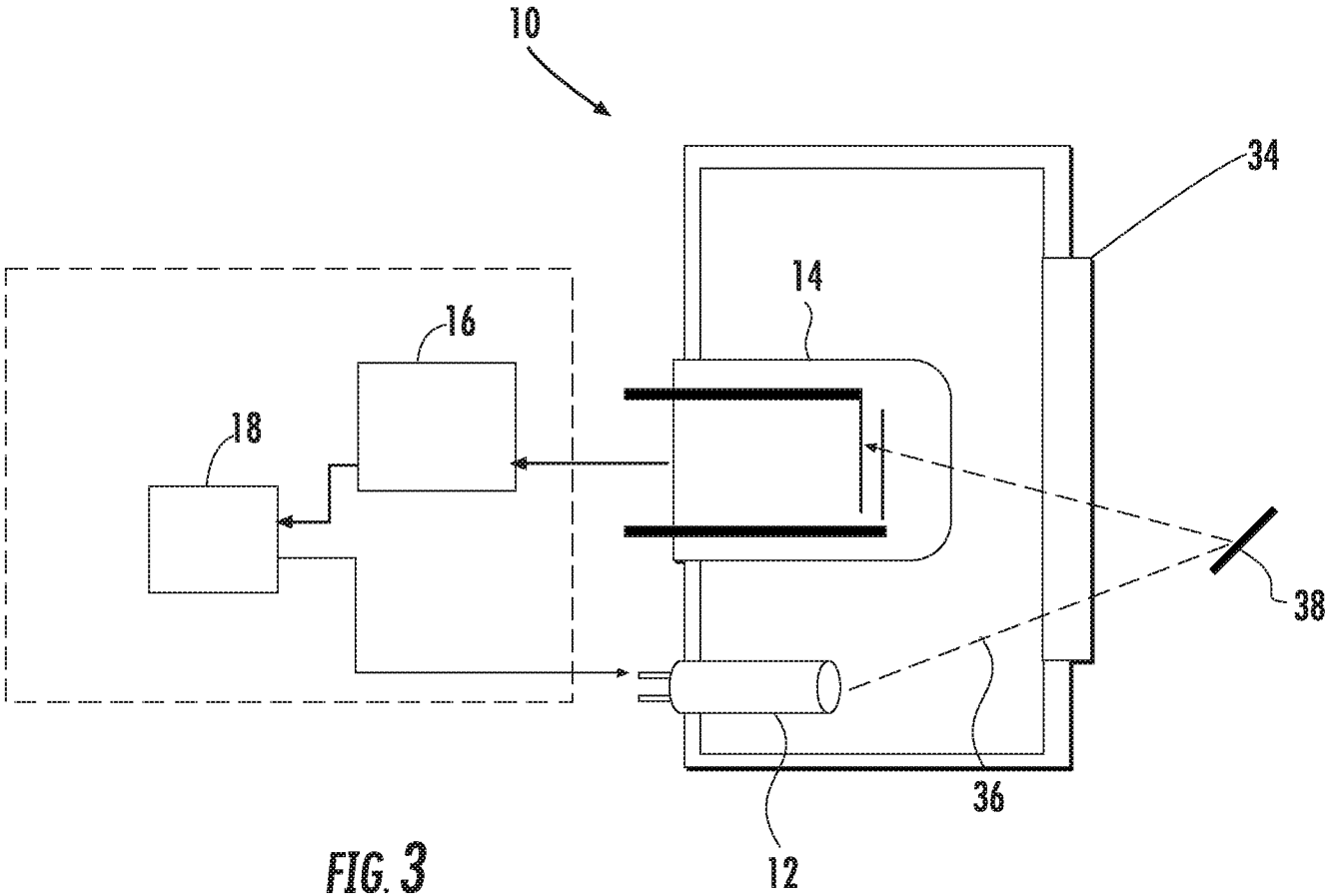
FIG. 3 illustrates a schematic diagram of a flame detector according to at least one embodiment of the present disclosure.

FIG. 3 illustrates the flame detector 10 undergoing an optical integrity test according to one embodiment of the present disclosure. The optical integrity test serves to evaluate the function of the sensor 14, the occlusion of a window 34, and the integrity of the microcontroller 16. It will be appreciated that the optical integrity test can also validate other aspects of flame detector 10, for example, such as, the power supply 18, to name one non-limiting example.

For example, during the optical integrity test, power supply 18 delivers power to the ultraviolet emitter 12 at a striking voltage less than or equal to approximately 230 volts. As a result, the ultraviolet emitter 12 emits ultraviolet light within the spectral range of approximately 220 nm to approximately 240 nm. It will be appreciated that ultraviolet emitter 12 may emit ultraviolet light within the normal ultraviolet spectral range between approximately 10 nm and approximately 400 nm. It will also be appreciated that ultraviolet emitter 12 may emit ultraviolet light at any rate or frequency that is appreciated in the arts. For example, the ultraviolet emitter 12 may pulse, or flash at a rate of approximately 10 milliseconds per cycle, to name a couple of non-limiting examples.

The test ultraviolet light 36, from the ultraviolet emitter 12, is directed through the window 34 and toward optical integrity (OI) mirror 38, which reflects the test ultraviolet light 36 back through the window 34 and toward the sensor 14. Upon detection of the test ultraviolet light 36, the sensor 14 transmits a signal to the microcontroller 16 where the signal is evaluated to determine whether the test ultraviolet light 36 has been detected. If the microcontroller 16 determines that the test ultraviolet light 36 has been detected, the microcontroller 16 subsequently transmits a signal indicating detection of the optical integrity signal. It will be appreciated that ultraviolet emitter 12 operates accurately and efficiently to avoid false alarms. For example, when the microcontroller 16 produces a signal to provide power from the power supply 18 to the ultraviolet emitter 12 to emit the test ultraviolet light 36, the microcontroller 16 expects the sensor 14 to transmit a detection signal within a threshold time period. A threshold time period can be less than or equal to approximately 10 milliseconds, to name one non-limiting example. If there is a delay or a failure in emitting the test ultraviolet light 36 by the ultraviolet emitter 12, for example, due to the dark effect, the sensor 14 will either not detect the test ultraviolet light 36 or detection of the test ultraviolet light 36 will be delayed. The lack of detection or delay in detection may be interpreted by the microcontroller 16 as a failure of the microcontroller 16, or a failure of the sensor 14, or occlusion of the window 34. Any of these failures would prompt the microcontroller 16 to trigger a fault condition to alert the user of a possible failure in the flame detector 10.

Figure 4:
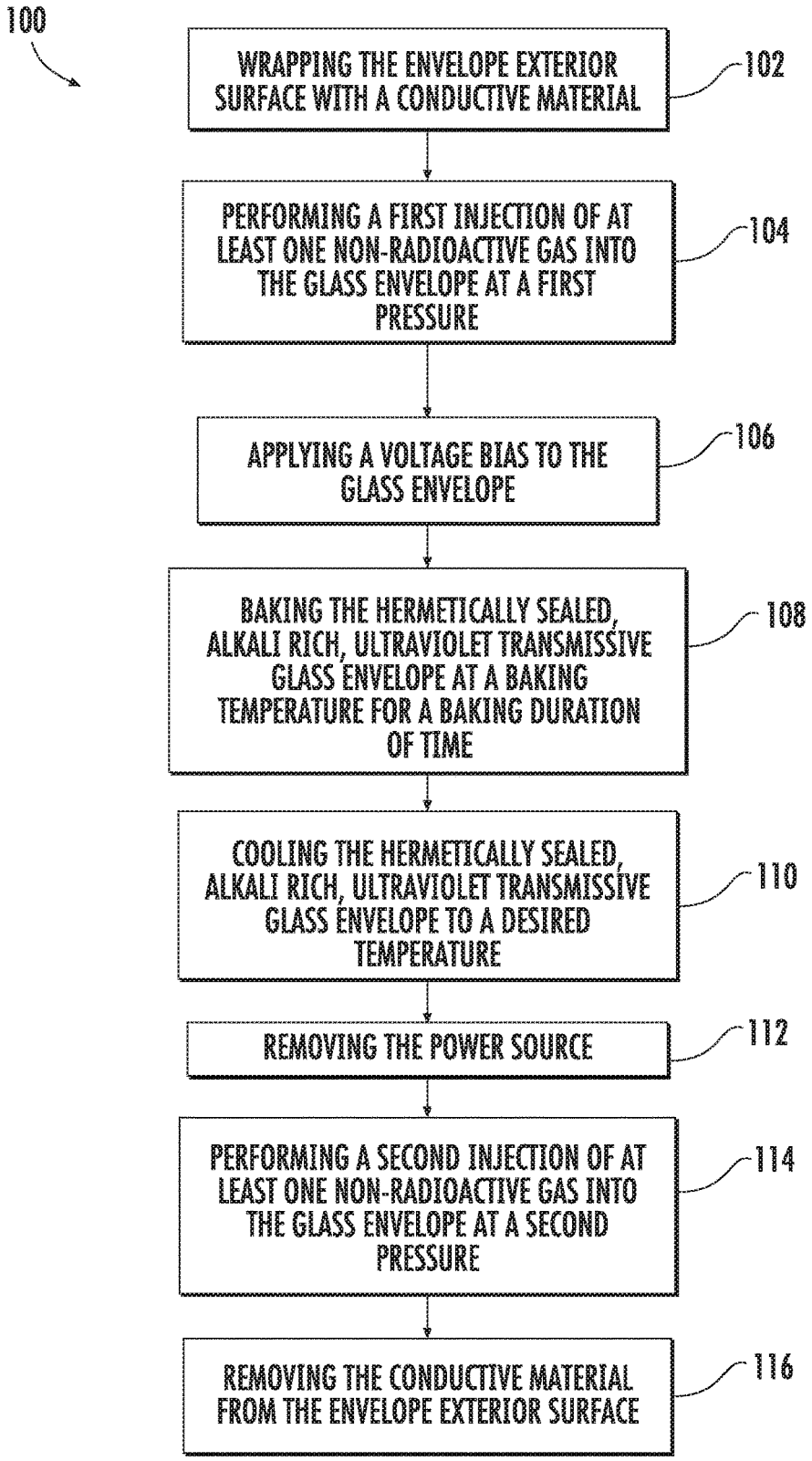
FIG. 4 is a flowchart illustrating a method of manufacturing the UV emitter of a flame detector according to at least one embodiment of the present disclosure.
Figure 5:
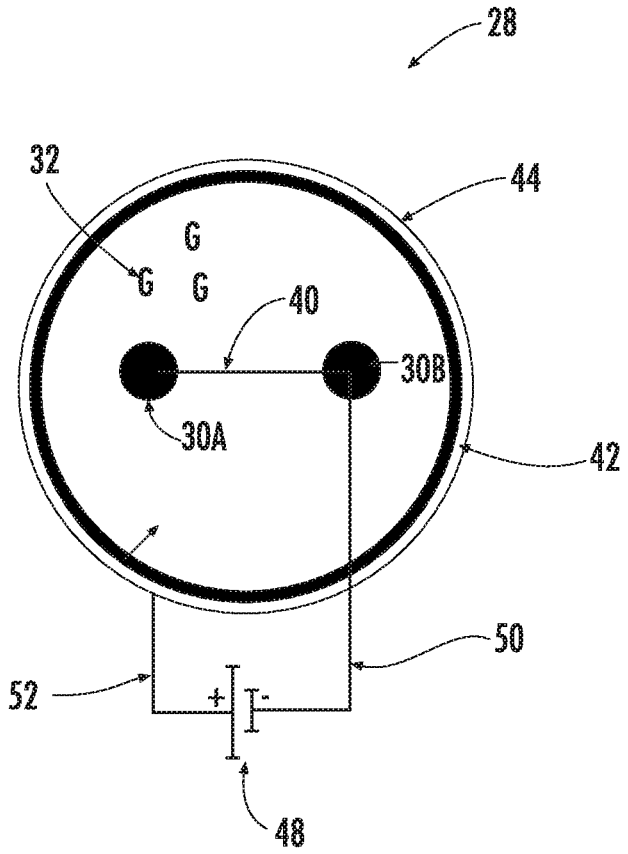
FIG. 5 illustrates a schematic diagram of a flame detector according to at least one embodiment of the present disclosure.

FIG. 4 illustrates a method of manufacturing the ultraviolet emitter 12, the method generally indicated at 100. The method 100 includes step 102 of wrapping an exterior surface 42 of the hermetically sealed, alkali rich, ultraviolet transmissive glass envelope 24 with a conductive material 44 having a conductive material length. For example, the conductive material 44 wraps circumferentially around the exterior surface 42 of the hermetically sealed, alkali rich, ultraviolet transmissive glass envelope 24, as shown for example in FIG. 5. In one embodiment, the conductive material 44 is selected from a group consisting of a wire mesh and a spring. It will be appreciated that the conductive material 44 may be composed of aluminum or steel, to name a couple of non-limiting examples. In one embodiment, the conductive material length is less than a length extending from the envelope distal end 28 to the envelope proximal end 26.

The method 100 further includes step 104 of performing a first injection of at least one non-radioactive gas 32 into the hermetically sealed, alkali rich, ultraviolet transmissive glass envelope 24 at a first pressure. In one embodiment, the at least one non-radioactive gas 32 is selected from the group consisting of hydrogen, helium, neon, argon, and xenon. For example, the non-radioactive gas 32 may include a mixture of approximately 85% neon, approximately 15% hydrogen, and trace amounts of argon. In one embodiment, the first pressure of is greater than or equal to approximately 17 Torr. It will also be appreciated that the first pressure of may be less than approximately 17 Torr. It will be appreciated that the first injection of at least one non-radioactive gas 32 reduces the electrical resistance of the current path between the conductive material 44 and the inner electrode(s). This results from the fact that a glow discharge takes place under the applied voltage bias during the baking process, as described further below with reference to step 108. Without the first injection of at least one non-radioactive gas 32 during this portion of the process, the electrical current path is small and is limited to surface conduction along the inner walls of the glass envelope 24. Under the applied bias, combined with the baking process to lower the electrical resistance through the glass envelope 24 from the conductive material 44, a glow discharge is produced between the inner surface of the glass envelope 24 and the inner electrode(s). The electrical resistance of this glow discharge is very low; thus, in an embodiment in which the alkali rich glass envelope 24 contains sodium, for example, the amount of sodium ion current that can flow from the outside of the glass envelope 24 to the inside of the glass envelope 24 is greatly enhanced, allowing the sodium migration to take place in a relatively short period of time. Additionally, this enhancement of ion flow at the point where the discharge takes place tends to concentrate the migrated sodium at the point of location of the conductive material 44 rather than at the base of the ultraviolet emitter 12.

The method 100 further includes step 106 of applying a voltage bias to the hermetically sealed, alkali rich, ultraviolet transmissive glass envelope 24. In one embodiment, applying a voltage bias includes connecting a power source 48 to the conductive material 44 and the at least one electrode 30. For example, with reference to FIG. 5, an emitter connection 40 is applied to connect anode 30A to cathode 30B. The negative terminal of power source 48 is connected to the cathode 30B via a connection 50, and the positive terminal of the power source 48 is connected to the conductive material 44 via a connection 52. In one embodiment, the voltage bias is greater than or equal to approximately 1,900 volts. It will be also appreciated that the voltage bias may be less than 1,900 volts. It will be appreciated that emitter connection 40 may be composed of one or more conductive materials well known in the arts, such as, nickel-iron alloy, or copper to name a couple of non-limiting examples.

The method 100 further includes step 108 of baking the hermetically sealed, alkali rich, ultraviolet transmissive glass envelope 24 at a baking temperature for a baking duration of time. In one embodiment, the baking temperature is greater than or equal to approximately 260 degrees Celsius (approximately 500 degrees Fahrenheit). It will also be appreciated that the baking temperature may be less than approximately 260 degrees Celsius (approximately 500 degrees Fahrenheit). In one embodiment, the baking duration of time is less than or equal to approximately 3.5 hours. It will also be appreciated that the baking duration of time may be greater than approximately 3.5 hours. The hermetically sealed, alkali rich, ultraviolet transmissive glass envelope 24 may be baked in a vacuum oven (not shown) at a vacuum pressure less than or equal to approximately $10^{-6}$ Torr. In such instances, the baking temperature may be greater than or equal to approximately 300 degrees Celsius (approximately 572 degrees Fahrenheit); however, it will be appreciated that the baking temperature may be less than or equal to approximately 300 degrees Celsius (approximately 572 degrees Fahrenheit).

The method 100 further includes step 110 of cooling the hermetically sealed, alkali rich, ultraviolet transmissive glass envelope 24 until the glass envelope reaches a desired temperature. In one embodiment, the desired temperature is approximately room temperature. It will be appreciated that the voltage bias may be maintained during step 110 to help promote the migration of positively charged ions (e.g. sodium ions).

The method 100 further includes the step 112 of removing the power source 48 from the hermetically sealed, alkali rich, ultraviolet transmissive glass envelope 24.

The method 100 further includes step 114 of performing a second injection of the at least one non-radioactive gas 32 into the hermetically sealed, alkali rich, ultraviolet transmissive glass envelope 24 at a second pressure. In one embodiment, the at least one non-radioactive gas 32 is selected from the group consisting of hydrogen, helium, neon, argon, and xenon. For example, the non-radioactive gas 32 includes a mixture of approximately 85% neon, approximately 15% hydrogen, and trace amounts of argon. In one embodiment, the second pressure is greater than or equal to approximately 35 Torr. It will be appreciated that the second pressure may be less than approximately 35 Torr. The second injection of the at least one non-radioactive gas 32 provides the necessary composition to allow the ultraviolet emitter 12 to perform at the desired strike voltage.

It will be appreciated that after performing a second injection of the at least one non-radioactive gas 32 into the hermetically sealed, alkali rich, ultraviolet transmissive glass envelope 24 at a second pressure, the hermetically sealed, alkali rich, ultraviolet transmissive glass envelope 24 is sealed by known methods in the art; In step 116, the conductive material 44 is removed from the exterior surface 42 of the hermetically sealed, alkali rich, ultraviolet transmissive glass envelope 24.

It will therefore be appreciated that flame detector 10 includes an ultraviolet emitter 12, including non-radioactive gasses 32, with a strike voltage of less than or equal to approximately 230 volts. It will be appreciated that flame detector 10 allows for effective and reliable UV flame detection without a need for radioactive materials.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A flame detector comprising:

an ultraviolet emitter comprising;

a hermetically sealed, alkali rich glass envelope including an envelope proximal end, an envelope distal end, and a cavity defined therein;

at least one electrode extending through the envelope proximal end into the cavity; and at least one non-radioactive gas disposed within the glass envelope, said at least one non-radioactive gas comprising a majority of neon, a minority of hydrogen, and trace amounts of argon;

a sensor configured to detect ultraviolet light; and wherein the ultraviolet emitter is configured to emit ultraviolet light at a strike voltage less than or equal to approximately 230 volts.

2. The flame detector of claim 1, wherein said flame detector further comprises:

a microcontroller operably coupled to the sensor; and a power supply operably coupled to the microcontroller, the ultraviolet emitter, and the sensor.

3. The flame detector of claim 1, wherein the at least one electrode comprises an anode and a cathode.

4. The flame detector of claim 1, wherein said at least one non-radioactive comprises approximately 85% neon, approximately 15% hydrogen, and trace amounts of argon.

5. A method of manufacturing an ultraviolet emitter for use in a flame detector, the ultraviolet emitter comprising a hermetically sealed, alkali rich, ultraviolet transmissive glass envelope including an envelope proximal end, an envelope distal end, a cavity disposed therein, an envelope length, an envelope exterior surface, and at least one electrode extending through the envelope proximal end into the cavity, the method comprising:

(a) wrapping the envelope exterior surface with a conductive material;

(b) performing a first injection of at least one non-radioactive gas into the glass envelope at a first pressure;

(c) applying a voltage bias to the glass envelope;

(d) baking the hermetically sealed, alkali rich, ultraviolet transmissive glass envelope at a baking temperature for a baking duration of time;

(e) cooling the hermetically sealed, alkali rich, ultraviolet transmissive glass envelope to a desired temperature; and (f) performing a second injection of at least one non-radioactive gas into the glass envelope at a second pressure.

6. The method of claim 5, wherein the conductive material is selected from a group consisting of a wire mesh and a spring, wherein the conductive material comprises a conductive material length.

7. The method of claim 6, wherein the conductive material length is less than an envelope length, wherein the envelope length is the length between the envelope proximal end and the envelope distal end.

8. The method of claim 6, wherein the at least one non-radioactive gas is selected from a group consisting of hydrogen, helium, neon, argon, and xenon.

9. The method of claim 6, wherein the first pressure is greater than or equal to approximately 17 Torr.

10. The method of claim 6, wherein step (c) comprises:

connecting a power source to the conductive material and the at least one electrode.

11. The method of claim 10, wherein the at least one electrode comprises an anode in electrical communication with a cathode.

12. The method of claim 11, wherein the applied voltage bias is greater than or equal to approximately 1,900 volts.

13. The method of claim 6, wherein the baking temperature is greater than or equal to approximately 260 degrees Celsius.

14. The method of claim 6, wherein the baking duration of time is less than or equal to approximately 3.5 hours.

15. The method of claim 6, wherein the desired temperature is approximately room temperature.

16. The method of claim 6, wherein the second pressure is greater than or equal to approximately 35 Torr.

17. The method of claim 6, further comprising the steps:

(g) removing the power source prior to step (f); and (h) removing the conductive material from the envelope exterior surface.

18. The method of claim 5, wherein the at least one non-radioactive gas comprises approximately 85% neon, approximately 15% hydrogen, and trace amounts of argon.

* * * * *